United States Patent [19]

Thomson

[11] Patent Number: 5,023,910

[45] Date of Patent: Jun. 11, 1991

[54] VECTOR QUANTIZATION IN A HARMONIC SPEECH CODING ARRANGEMENT

[75] Inventor: David L. Thomson, Lisle, Ill.

[73] Assignee: AT&T Bell Laboratories, Murray Hill, N.J.

[21] Appl. No.: 321,119

[22] Filed: Apr. 8, 1989

[51] Int. Cl.[5] ..... G10L 7/02

[52] U.S. Cl. ..... 381/37

[58] Field of Search ..... 381/29-41; 364/513.5

[56] References Cited

U.S. PATENT DOCUMENTS

| | | | |
|---|---|---|---|
| 4,184,049 | 1/1980 | Crochiere et al. | 179/1 SA |
| 4,771,465 | 9/1988 | Bronson et al. | 381/36 |
| 4,791,654 | 12/1988 | DeMarca et al. | 381/29 |
| 4,797,926 | 1/1989 | Bronson et al. | 381/37 |
| 4,815,135 | 3/1989 | Taguchi | 381/37 |
| 4,852,179 | 7/1989 | Fette | 381/29 |
| **4,885,790** | **12/1989** | **McAulay et al.** | 381/36 |

FOREIGN PATENT DOCUMENTS 0259950 7/1987 European Pat. Off. .

OTHER PUBLICATIONS

1980 *Acoustical Society of America,* vol. 68, No. 2, J. L. Flanagan, "Parametric Coding of Speech Spectra", Aug., 1980, pp. 412-431.

*IEEE Transaction on Acoustics, Speech, and Signaling Processing,* vol. ASSP-31, Jun., 1983, L. B. Almeida, et al., "Nonstationary Spectral Modeling of Voiced Speech", pp. 664-677.

1984, *IEEE CH*1945-5/84/0000-0289, L. B. Almeida, et al., "Variable-Frequency Synthesis: An Improved Harmonic Coding Scheme", pp. 27.5.1-27.5.4.

1984 *IEEE CH*1945-5/84/0000-0290, R. J. McAulay, et al., "Magnitude-Only Reconstruction Using a Sinusoidal Speech Model", pp. 27.6.1-27.6.4.

1984 *IEEE CH*2028-9/84/0000-1179, Y. Shoham, et al., "Pitch Synchronous Transform Coding of Speech at 9.6 kb/s Based on Vector Quantization", pp. 1179-1182.

1985 *IEEE CH*2118-8/85/0000-0260, I. M. Trancoso, et al., "Pole-Zero Multipulse Speech Representation Using Harmonic Modelling in the Frequency Domain", pp. 260-263.

1986 *IEEE CH*2243-4/86/0000-1233, J. S. Marques, et al., "A Background for Sinusoid Based Representation of Voiced Speech", pp. 1233-1236.

1986 *IEEE CH*2243-4/86/0000-1713, R. J. McAulay, et al., "Phase Modelling and ITS Application to Sinusoidal Transform Coding", pp. 1713-1715.

1986 *IEEE CH*2243-4/86/0000-1709, I. M. Trancoso, et al., "A Study on the Relationships Between Stochastic and Harmonic Coding", pp. 1709-1712.

1986 *IEEE* 0096-3518/86/0800-0744, R. J. McAulay, et al., "Speech Analysis/Synthesis Based on a Sinusoidal Representation", pp. 744-754.

1987 *IEEE CH*2396-0/87/0000-1645, R. J. McAulay, et al., "Multirate Sinusoidal Transform Coding at Rates from 2.4 kbps to 8 kbps", pp. 1645-1648.

1987 *IEEE CH*2396-0/87/0000-2213, E. C. Bronson, et al., "Harmonic Coding of Speech at 4.8 kb/s", pp. 2213-2216.

List continue on next page.

*Primary Examiner*—Gary V. Harkcom
*Assistant Examiner*—John A. Merecki
*Attorney, Agent, or Firm*—Ross T. Watland

[57] ABSTRACT

A harmonic speech coding arrangement where vector quantization is used to improve speech quality. Parameters are determined at the analyzer of an illustrative coding arrangement to model the magnitude and phase spectra of the input speech. A first codebook of vectors is searched for a vector that closely approximates the difference between the true and estimated magnitude spectra. A second codebook of vectors is searched for a vector that closely approximates the difference between the true and the estimated phase spectra. Indices and scaling factors for the vectors are communicated to the synthesizer such that scaled vectors can be added into the magnitude and phase spectra for use at the synthesizer in generating speech as a sum of sinusoids.

20 Claims, 13 Drawing Sheets

OTHER PUBLICATIONS

*Onzieme Colloque Gretsi—Nice Du* 1*er Au* 5 Jun. 1987, J. S. Marques, et al., "Quasi-Optimal Analysis for Sinusoidal Representation of Speech".

1987 *IEEE* 0090-6778/87/1000-1059, P-C Chang, et al., "Fourier Transform Vector Quantization for Speech Coding", pp. 1059-1068.

1987 *IEEE CH*2396-0/87/0000-1641, E. B. George, et al., "A New Speech Coding Model based on a Least-Squares Sinusoidal Representation", pp. 1641-1644.

D. W. Griffin, et al., "A High Quality 9.6 kbps Speech Coding System", ICASSP 86, Tokyo, pp. 125-128.

I. M. Trancoso, et al., "Harmonic Coding—State of the Art and Future Trends", *Speech Communication*, Jul. 7, 1988, No. 2, Amsterdam, the Netherlands, pp. 239-245.

SPEECH ANALYSIS PROGRAM

SPEECH SYNTHESIS PROGRAM

SPEECH ANALYSIS PROGRAM

SPEECH SYNTHESIS PROGRAM

VECTOR QUANTIZATION IN A HARMONIC SPEECH CODING ARRANGEMENT

CROSS-REFERENCE TO RELATED APPLICATION

This application is related to the application D. L. Thomson Ser. No. 179,170, "Harmonic Speech Coding Arrangement", filed concurrently herewith and assigned to the assignee of the present invention.

MICROFICHE APPENDIX

Included in this application is a Microfiche Appendix. The total number of microfiche is one sheet and the total number of frames is 34.

TECHNICAL FIELD

This invention relates to speech processing.

BACKGROUND AND PROBLEM

Accurate representations of speech have been demonstrated using harmonic models where a sum of sinusoids is used for synthesis. An analyzer partitions speech into overlapping frames, Hamming windows each frame, constructs a magnitude/phase spectrum, and locates individual sinusoids. The correct magnitude, phase, and frequency of the sinusoids are then transmitted to a synthesizer which generates the synthetic speech. In an unquantized harmonic speech coding system, the resulting speech quality is virtually transparent in that most people cannot distinguish the original from the synthetic. The difficulty in applying this approach at low bit rates lies in the necessity of coding up to 80 harmonics. (The sinusoids are referred to herein as harmonics, although they are not always harmonically related.) Bit rates below 9.6 kilobits/second are typically achieved by incorporating pitch and voicing or by dropping some or all of the phase information. The result is synthetic speech differing in quality and robustness from the unquantized version.

One prior art quantized harmonic speech coding arrangement is disclosed in R. J. McAulay and T. F. Quatieri, "Multirate sinusoidal transform coding at rates from 2.4 kbps to 8 kbps," *Proc. IEEE Int. Conf. Acoust., Speech, and Signal Proc.*, vol. 3, pp. 1645–1648, April 1987. Parameters are determined at an analyzer to model the speech and each parameter is quantized by chosing the closest one of a number of discrete values that the parameter can take on. This procedure is referred to as scalar quantization since only individual parameters are quantized. Although the McAulay arrangement generates synthetic speech of good quality, a need exists in the art for harmonic coding arrangements of improved speech quality.

SOLUTION

The aforementioned need is met and a technical advance is achieved in accordance with the principles of the invention where a procedure known as vector quantization is for the first time applied in a harmonic speech coding arrangement to improve speech quality. Parameters are determined at the analyzer of an illustrative embodiment described herein to model the magnitude and phase spectra of the input speech. A first codebook of vectors is searched for a vector that closely approximates the difference between the true and estimated magnitude spectra. A second codebook of vectors is searched for a vector that closely approximates the difference between the true and the estimated phase spectra. Indices and scaling factors for the vectors are communicated to the synthesizer such that scaled vectors can be added into the estimated magnitude and phase spectra for use at the synthesizer in generating speech as a sum of sinusoids.

At an analyzer of a harmonic speech coding arrangement, speech is processed in accordance with a method of the invention by first determining a spectrum from the speech. Based on the determined spectrum, a set of parameters is calculated modeling the speech, the parameter set being usable for determining a plurality of sinusoids. The parameter set is communicated for speech synthesis as a sum of the sinusoids. The parameter set includes a subset of the parameter set computed based on the determined spectrum for use in determining sinusoidal frequency of at least one of the sinusoids. At least one parameter of the parameter set is an index to a codebook of vectors.

At a synthesizer of a harmonic speech coding arrangement, speech is synthesized in accordance with a method of the invention by receiving a set of parameters including at least one parameter that is an index to a codebook of vectors. The parameter set is processed to determine a plurality of sinusoids having nonuniformly spaced sinusoidal frequencies. At least one of the sinusoids is determined based in part on a vector of the codebook defined by the index. Speech is then synthesized as a sum of the sinusoids.

In a harmonic speech coding arrangement including both an analyzer and a synthesizer, speech is processed in accordance with a method of the invention by first determining a spectrum from the speech, the spectrum comprising a plurality of samples. Based on the determined spectrum, a set of parameters is calculated modeling the speech including at least one parameter that is an index to a codebook of vectors. The parameter set is processed to determine a plurality of sinusoids, where the number of sinusoids is less that the number of samples of the determined spectrum. At least one of the sinusoids is determined based in part on a vector of the codebook defined by the index. Speech is then synthesized as a sum of the sinusoids.

At the analyzer of an illustrative harmonic speech coding arrangement described herein, both magnitude and phase spectra are determined and the calculated parameter set includes first parameters modeling the determined magnitude spectrum and second parameters modeling the determined phase spectrum. At least one of the first parameters is an index to a first codebook of vectors and at least one of the second parameters is an index to a second codebook of vectors. The vectors of the first codebook are constructed from a transform of a plurality of sinusoids with random frequencies and amplitudes. The vectors of the second codebook are constructed from white Gaussian noise sequences. The spectra are interpolated spectra determined from a Fast Fourier Transform of the speech.

At the synthesizer of the illustrative harmonic speech coding arrangement, the sinusoidal frequency, amplitude, and phase of each of the sinusoids used for synthesis are determined based in part on vectors defined by received indices.

In an alternative harmonic speech coding arrangement described herein, the parameter calculation is done by determining the sinusoidal amplitude, frequency, and phase of a plurality of sinusoids from the spectrum. In addition, the sinusoidal amplitude, frequency, and phase of the sinusoids are estimated based on the speech. Errors between the determined and estimated sinusoidal amplitudes, frequencies, and phases are then vector quantized.

DRAWING DESCRIPTION

GENERAL DESCRIPTION

Figure 1:
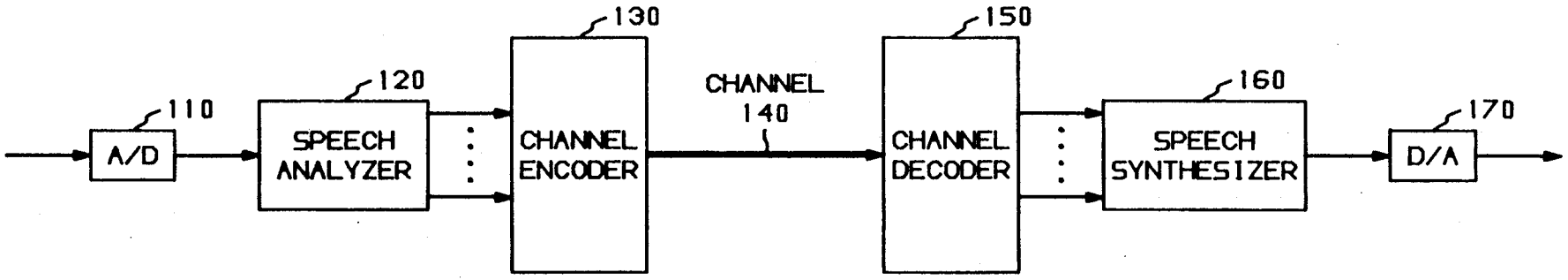
FIG. 1 is a block diagram of an exemplary harmonic speech coding arrangement in accordance with the invention.

The approach of the present harmonic speech coding arrangement is to transmit the entire complex spectrum instead of sending individual harmonics. One advantage of this method is that the frequency of each harmonic need not be transmitted since the synthesizer, not the analyzer, estimates the frequencies of the sinusoids that are summed to generate synthetic speech. Harmonics are found directly from the magnitude spectrum and are not required to be harmonically related to a fundamental pitch.

To transmit the continuous speech spectrum at a low bit rate, it is necessary to characterize the spectrum with a set of continuous functions that can be described by a small number of parameters. Functions are found to match the magnitude/phase spectrum computed from a fast Fourier transform (FFT) of the input speech. This is easier than fitting the real/imaginary spectrum because special redundancy characteristics may be exploited. For example, magnitude and phase may be partially predicted from the previous frame since the magnitude spectrum remains relatively constant from frame to frame, and phase increases at a rate proportional to frequency.

Another useful function for representing magnitude and phase is a pole-zero model. The voice is modeled as the response of a pole-zero filter to ideal impulses. The magnitude and phase are then derived from the filter parameters. Error remaining in the model estimate is vector quantized. Once the spectra are matched with a set of functions, the model parameters are transmitted to the synthesizer where the spectra are reconstructed. Unlike pitch and voicing based strategies, performance is relatively insensitive to parameter estimation errors.

In the illustrative embodiment described herein, speech is coded using the following procedure:

ANALYSIS

1. Model the complex spectral envelope with poles and zeros.
2. Find the magnitude spectral envelope from the complex envelope.
3. Model fine pitch structure in the magnitude spectrum.
4. Vector quantize the remaining error.
5. Evaluate two methods of modeling the phase spectrum:

a. Derive phase from the pole-zero model.

b. Predict phase from the previous frame.

6. Choose the best method in step 5 and vector quantize the residual error.
7. Transmit the model parameters.

SYNTHESIS:

1. Reconstruct the magnitude and phase spectra.
2. Determine the sinusoidal frequencies from the magnitude spectrum.
3. Generate speech as a sum of sinusoids.

MODELING THE MAGNITUDE SPECTRUM

To represent the spectral magnitude with as few parameters as possible, advantage is taken of redundancy in the spectrum. The magnitude spectrum consists of an envelope defining the general shape of the spectrum and approximately periodic components that give it a fine structure. The smooth magnitude spectral envelope is represented by the magnitude response of an all-pole or pole-zero model. Pitch detectors are capable of representing the fine structure when periodicity is clearly present but often lack robustness under non-ideal conditions. In fact, it is difficult to find a single parametric function that closely fits the magnitude spectrum for a wide variety of speech characteristics. A reliable estimate may be constructed from a weighted sum of several functions. Four functions that were found to work particularly well are the estimated magnitude spectrum of the previous frame, the magnitude spectrum of two periodic pulse trains and a vector chosen from a codebook. The pulse trains and the codeword are Hamming windowed in the time domain and weighted in the frequency domain by the magnitude envelope to preserve the overall shape of the spectrum. The optimum weights are found by well-known mean squared error (MSE) minimization techniques. The best frequency for each pulse train and the optimum code vector are not chosen simultaneously. Rather, one frequency at at time is found and then the codeword is chosen. If there are m functions $d_i(\omega)$, $1 \leqq i \leqq m$, and corresponding weights $a_{i,m}$, then the estimate of the magnitude spectrum $|F(\omega)|$ is $$|F(\omega)| = \sum_{i=1}^{m} a_{i,m} d_i(\omega). \tag{1}$$

Note that the magnitude spectrum is modeled as a continuous spectrum rather than a line spectrum. The optimum weights are chosen to minimize $$\int_0^{\omega_s/2} \left[ |F(\omega)| - \sum_{i=1}^{m} a_{i,m} d_i(\omega) \right]^2 d\omega, \tag{2}$$

where $F(\omega)$ is the speech spectrum, $\omega_s$ is the sampling frequency, and m is the number of functions included.

The frequency of the first pulse train is found by testing a range (40–400 Hz) of possible frequencies and selecting the one that minimizes (2) for m=2. For each candidate frequency, optimal values of $\alpha_{i,m}$, are computed. The process is repeated with m=3 to find the second frequency. When the magnitude spectrum has no periodic structure as in unvoiced speech, one of the pulse trains often has a low frequency so that windowing effects cause the associated spectrum to be relatively smooth.

The code vector is the entry in a codebook that minimizes (2) for m=4 and is found by searching. In the illustrative embodiment described herein, codewords were constructed from the FFT of 16 sinusoids with random frequencies and amplitudes.

PHASE MODELING

Proper representation of phase in a sinusoidal speech synthesizer is important in achieving good speech quality. Unlike the magnitude spectrum, the phase spectrum need only be matched at the harmonics. Therefore, harmonics are determined at the analyzer as well as at the synthesizer. Two methods of phase estimation are used in the present embodiment. Both are evaluated for each speech frame and the one yielding the least error is used. The first is a parametric method that derives phase from the spectral envelope and the location of a pitch pulse. The second assumes that phase is continuous and predicts phase from that of the previous frame.

Homomorphic phase models have been proposed where phase is derived from the magnitude spectrum under assumptions of minimum phase. A vocal tract phase function $\phi_k$ may also be derived directly from an all-pole model. The actual phase $\theta_k$ of a harmonic with frequency $\omega_k$ is related to $\phi_k$ by $$\theta_k=\phi_k-t_0\omega_k+2\pi\lambda+\epsilon_k, \tag{3}$$

where $t_0$ is the location in time of the onset of a pitch pulse, $\lambda$ is an integer, and $\epsilon_k$ is the estimation error or phase residual.

The variance of $\epsilon_k$ may be substantially reduced by replacing the all-pole model with a pole-zero model. Zeros aid representation of nasals and speech where the shape of the glottal pulse deviates from an ideal impulse. In accordance with a method that minimizes the complex spectral error, a filter $H(\omega_k)$ consisting of p poles and q zeros is specified by coefficients $a_i$ and $b_i$ where $$H(\omega_k)=\frac{\sum_{i=0}^{q} b_i e^{-j\omega ki}}{\sum_{i=0}^{p} a_i e^{-j\omega ki}}. \tag{4}$$

The optimum filter minimizes the total squared spectral error $$E_s=\sum_{k=1}^{K} \left|e^{-j\omega k t_0}H(\omega_k)-F(\omega_k)\right|^2. \tag{5}$$

Since $H(\omega_k)$ models only the spectral envelope, $\omega_k$, $1\leqq k\leqq K$, corresponds to peaks in the magnitude spectrum. No closed form solution for this expression is known so an iterative approach is used. The impulse is located by trying a range of values of $t_0$ and selecting the value that minimizes $E_s$. Note that $H(\omega_k)$ is not constrained to be minimum phase. There are cases where the pole-zero filter yields an accurate phase spectrum, but gives errors in the magnitude spectrum. The simplest solution in these cases is to revert to an all-pole filter.

The second method of estimating phase assumes that frequency changes linearly from frame to frame and that phase is continuous. When these conditions are met, phase may be predicted from the previous frame. The estimated increase in phase of a harmonic is $t\bar{\omega}_k$ where $\bar{\omega}_k$ is the average frequency of the harmonic and t is the time between frames. This method works well when good estimates for the previous frame are available and harmonics are accurately matched between frames.

After phase has been estimated by the method yielding the least error, a phase residual $\epsilon_k$ remains. The phase residual may be coded by replacing $\epsilon_k$ with a random vector $\Psi_{c,k}$, $1\leqq c\leqq C$, selected from a codebook of C codewords. Codeword selection consists of an exhaustive search to find the codeword yielding the least mean squared error (MSE). The MSE between two sinusoids of identical frequency and amplitude $A_k$ but differing in phase by an angle $\nu_k$ is $A_k^2[1-\cos(\nu_k)]$. The codeword is chosen to minimize $$\sum_{k=1}^{K} A_k^2[1-\cos(\epsilon_k-\Psi_{c,k})] \tag{6}$$

This criterion also determines whether the parametric or phase prediction estimate is used.

Since phase residuals in a given spectrum tend to be uncorrelated and normally distributed, the codewords are constructed from white Gaussian noise sequences. Code vectors are scaled to minimize the error although the scaling factor is not always optimal due to nonlinearities.

HARMONIC MATCHING

Correctly matching harmonics from one frame to another is particularly important for phase prediction. Matching is complicated by fundamental pitch variation between frames and false low-level harmonics caused by sidelobes and window subtraction. True harmonics may be distinguished from false harmonics by incorporating an energy criterion. Denote the amplitude of the $k^{th}$ harmonic in frame m by $A_k^{(m)}$. If the energy normalized amplitude ratio $$\left[[A_k^{(m)}]^2/\sum_{i=1}^{K}[A_i^{(m)}]^2\right]/\left[[A_l^{(m-1)}]^2/\sum_{i=1}^{K}[A_i^{(m-1)}]^2\right] \tag{7}$$

or its inverse is greater than a fixed threshold, then $A_k^{(m)}$ and $A_l^{(m-1)}$ likely do not correspond to the same harmonic and are not matched. The optimum threshold is experimentally determined to be about four, but the exact value is not critical.

Pitch changes may be taken into account by estimating the ratio $\gamma$ of the pitch in each frame to that of the previous frame. A harmonic with frequency $\omega_k^{(m)}$ is considered to be close to a harmonic of frequency $\omega_k^{(m-1)}$ if the adjusted difference frequency $$|\omega_k^{(m)}-\gamma\omega_l^{(m-1)}| \tag{8}$$

is small. Harmonics in adjacent frames that are closest according to (8) and have similar amplitudes according to (7) are matched. If the correct matching were known, $\gamma$ could be estimated from the average ratio of the pitch of each harmonic to that of the previous frame weighted by its amplitude $$\gamma = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}}. \tag{9}$$

The value of $\gamma$ is unknown but may be approximated by initially letting $\hat{\gamma}$ equal one and iteratively matching harmonics and updating $\hat{\gamma}$ until a stable value is found. This procedure is reliable during rapidly changing pitch and in the presence of false harmonics.

SYNTHESIS

A unique feature of the parametric model is that the frequency of each sinusoid is determined from the magnitude spectrum by the synthesizer and need not be transmitted. Since windowing the speech causes spectral spreading of harmonics, frequencies are estimated by locating peaks in the spectrum. Simple peak-picking algorithms work well for most voiced speech, but result in an unnatural tonal quality for unvoiced speech. These impairments occur because, during unvoiced speech, the number of peaks in a spectral region is related to the smoothness of the spectrum rather than the spectral energy.

The concentration of peaks can be made to correspond to the area under a spectral region by subtracting the contribution of each harmonic as it is found. First, the largest peak is assumed to be a harmonic. The magnitude spectrum of the scaled, frequency shifted Hamming window is then subtracted from the magnitude spectrum of the speech. The process repeats until the magnitude spectrum is reduced below a threshold at all frequencies.

When frequency estimation error due to FFT resolution causes a peak to be estimated to one side of its true location, portions of the spectrum remain on the other side after window subtraction, resulting in a spurious harmonic. Such artifacts of frequency errors within the resolution of the FFT may be eliminated by using a modified window transform $W'_i = \max(W_{i-1}, W_i, W_{i+1})$, where $W_i$ is a sequence representing the FFT of the time window. $W'_i$ is referred to herein as a wide magnitude spectrum window. For large FFT sizes, $W'_i$ approaches $W_i$.

To prevent discontinuities at frame boundaries in the present embodiment, each frame is windowed with a raised cosine function overlapping halfway into the next and previous frames. Harmonic pairs in adjacent frames that are matched to each other are linearly interpolated in frequency so that the sum of the pair is a continuous sinusoid. Unmatched harmonics remain at a constant frequency.

DETAILED DESCRIPTION

An illustrative speech processing arrangement in accordance with the invention is shown in block diagram form in FIG. 1. Incoming analog speech signals are converted to digitized speech samples by an A/D converter 110. The digitized speech samples from converter 110 are then processed by speech analyzer 120. The results obtained by analyzer 120 are a number of parameters which are transmitted to a channel encoder 130 for encoding and transmission over a channel 140. A channel decoder 150 receives the quantized parameters from channel 140, decodes them, and transmits the decoded parameters to a speech synthesizer 160. Synthesizer 160 processes the parameters to generate digital, synthetic speech samples which are in turn processed by a D/A converter 170 to reproduce the incoming analog speech signals.

A number of equations and expressions (10) through (26) are presented in Tables 1, 2 and 3 for convenient reference in the following description.

TABLE 1

$$\text{nrg} = \frac{8L}{3W} \sum_{i=0}^{W-1} s_i^2 \tag{10}$$

$$H(\omega_k) = \frac{1}{\sum_{i=0}^{p} a_i e^{-j\omega k i}} \tag{11}$$

$$\sum_{k=1}^{K} [|H(\omega_k)| - |F(\omega_k)|]^2 \tag{12}$$

$$\text{alpha1} = \text{oldalpha1} + \frac{0.9*8i^3}{(SR1)^3} \tag{13}$$

$$f1 = 40e^{alpha1*ln(10)} \tag{14}$$

$$E_1 = \sum_{k=0}^{256} \left[ |F(k)| - \sum_{i=1}^{2} \alpha_{i,2} d_i(k) \right]^2 \tag{15}$$

$$\text{alpha2} = \text{oldalpha2} + \frac{0.9*8i^3}{(SR2)^3} \tag{16}$$

TABLE 2

$$f2 = 40e^{alpha2*ln(10)} \tag{17}$$

$$E_2 = \sum_{k=0}^{256} \left[ |F(k)| - \sum_{i=1}^{3} \alpha_{i,3} d_i(k) \right]^2 \tag{18}$$

$$E_3 = \sum_{k=0}^{256} \left[ |F(k)| - \sum_{i=1}^{4} \alpha_{i,4} d_i(k) \right]^2 \tag{19}$$

$$|F(\omega)| = \sum_{i=1}^{4} \alpha_{i,4} d_i(\omega) \tag{20}$$

$$\rho = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}} \tag{21}$$

$$\theta(\omega_k) = \arg[e^{-j\omega k t_0} H(\omega_k)] \tag{22}$$

$$E_p = \sum_{k=1}^{K} A_k^2 [1 - \cos(\theta(\omega_k) - \theta(\omega_k))] \tag{23}$$

TABLE 3

$$\sum_{k=1}^{K} A_k^2 [1 - \cos(\theta(\omega_k) - \theta(\omega_k) - \gamma_c \Psi_{c,k})] \tag{24}$$

$$\theta(\omega_k) = \arg[e^{-j\omega k t_0} H(\omega_k)] + \gamma_c \Psi_{c,k} \tag{25}$$

$$\theta_m(\omega_k) = \frac{\omega_k^{(m)} + \omega_k^{(m-1)}}{2} t + \gamma_c \Psi_{c,k} \tag{26}$$

Figure 2:
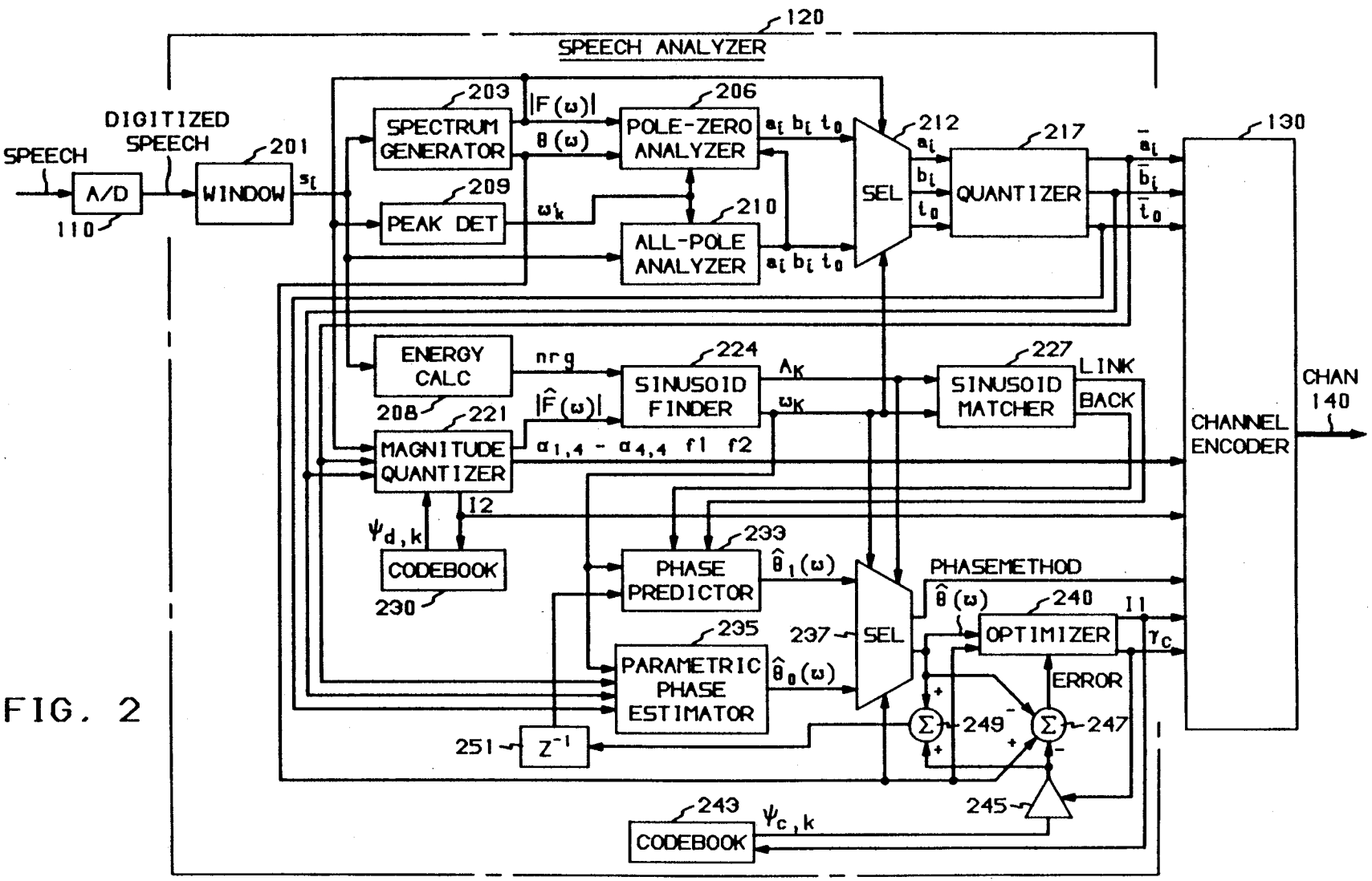
FIG. 2 is a block diagram of a speech analyzer included in the arrangement of FIG. 1.

Speech analyzer 120 is shown in greater detail in FIG. 2. Converter 110 groups the digital speech samples into overlapping frames for transmission to a window unit 201 which Hamming windows each frame to generate a sequence of speech samples, $S_i$. The framing and windowing techniques are well known in the art. A spectrum generator 203 performs an FFT of the speech samples, $S_i$, to determine a magnitude spectrum, $|F(\omega)|$, and a phase spectrum, $\theta(\omega)$. The FFT performed by spectrum generator 203 comprises a one-dimensional Fourier transform. The determined magnitude spectrum $|F(\omega)|$ is an interpolated spectrum in that it comprises a greater number of frequency samples than the number of speech samples, $S_i$, in a frame of speech. The interpolated spectrum may be obtained either by zero padding the speech samples in the time domain or by interpolating between adjacent frequency samples of a noninterpolated spectrum. An all-pole analyzer 210 processes the windowed speech samples, $S_i$, using standard linear predictive coding (LPC) techniques to obtain the parameters, $a_i$, for the all-pole model given by equation (11), and performs a sequential evaluation of equations (22) and (23) to obtain a value of the pitch pulse location, $t_0$, that minimizes $E_p$. The parameter, p, in equation (11) is the number of poles of the all-pole model. The frequencies $\omega_k$ used in equations (22), (23) and (11) are the frequencies $\omega'_k$ determined by a peak detector 209 by simply locating the peaks of the magnitude spectrum $|F(\omega)|$. Analyzer 210 transmits the values of $a_i$ and $t_0$ obtained together with zero values for the parameters, $b_i$, (corresponding to zeroes of a pole-zero analysis) to a selector 212. A pole-zero analyzer 206 first determines the complex spectrum, $F(\omega)$, from the magnitude spectrum, $|F(\omega)|$, and the phase spectrum, $\theta(\omega)$. Analyzer 206 then uses linear methods and the complex spectrum, $F(\omega)$, to determine values of the parameters $a_i$, $b_i$, and $t_0$ to minimize $E_s$ given by equation (5) where $H(\omega_k)$ is given by equation (4). The parameters, p and z, in equation (4) are the number of poles and zeroes, respectively, of the pole-zero model. The frequencies $\omega_k$ used in equations (4) and (5) are the frequencies $\omega'_k$ determined by peak detector 209. Analyzer 206 transmits the values of $a_i$, $b_i$, and $t_0$ to selector 212. Selector 212 evaluates the all-pole analysis and the pole-zero analysis and selects the one that minimizes the mean squared error given by equation (12). A quantizer 217 uses a well-known quantization method on the parameters selected by selector 212 to obtain values of quantized parameters, $\bar{a}_i$, $\bar{b}_i$, and $\bar{t}_0$, for encoding by channel encoder 130 and transmission over channel 140.

A magnitude quantizer 221 uses the quantized parameters $\bar{a}_i$ and $\bar{b}_i$, the magnitude spectrum $|\hat{F}(\omega)|$, and a vector, $\Psi_{d,k}$, selected from a codebook 230 to obtain an estimated magnitude spectrum, $|\hat{F}(\omega)|$, and a number of parameters $\alpha_{1,4}$, $\alpha_{2,4}$, $\alpha_{3,4}$, $\alpha_{4,4}$, f1, f2. Magnitude quantizer 221 is shown in greater detail in FIG. 4. A summer 421 generates the estimated magnitude spectrum, $|F(\omega)|$, as the weighted sum of the estimated magnitude spectrum of the previous frame obtained by a delay unit 423, the magnitude spectrum of two periodic pulse trains generated by pulse train transform generators 403 and 405, and the vector, $\Psi_{d,k}$, selected from codebook 230. The pulse trains and the vector or codeword are Hamming windowed in the time domain, and are weighted, via spectral multipliers 407, 409, and 411, by a magnitude spectral envelope generated by a generator 401 from the quantized parameters $\bar{a}_i$ and $\bar{b}_i$. The generated functions $d_1(\omega)$, $d_2(\omega)$, $d_3(\omega)$, $d_4(\omega)$ are further weighted by multipliers 413, 415, 417, and 419 respectively, where the weights $\alpha_{1,4}$, $\alpha_{2,4}$, $\alpha_{3,4}$, $\alpha_{4,4}$ and the frequencies f1 and f2 of the two periodic pulse trains are chosen by an optimizer 427 to minimize equation (2).

A sinusoid finder 224 (FIG. 2) determines the amplitude, $A_k$, and frequency, $\omega_k$, of a number of sinusoids by analyzing the estimated magnitude spectrum, $|\hat{F}(\omega)|$. Finder 224 first finds a peak in $|\hat{F}(\omega)|$. Finder 224 then constructs a wide magnitude spectrum window, with the same amplitude and frequency as the peak. The wide magnitude spectrum window is also referred to herein as a modified window transform. Finder 224 then subtracts the spectral component comprising the wide magnitude spectrum window from the estimated magnitude spectrum, $|\hat{F}(\omega)|$. Finder 224 repeats the process with the next peak until the estimated magnitude spectrum, $|\hat{F}(\omega)|$, is below a threshold for all frequencies. Finder 224 then scales the harmonics such that the total energy of the harmonics is the same as the energy, nrg, determined by an energy calculator 208 from the speech samples, $s_i$, as given by equation (10). A sinusoid matcher 227 then generates an array, BACK, defining the association between the sinusoids of the present frame and sinusoids of the previous frame matched in accordance with equations (7), (8), and (9). Matcher 227 also generates an array, LINK, defining the association between the sinusoids of the present frame and sinusoids of the subsequent frame matched in the same manner and using wellknown frame storage techniques.

A parametric phase estimator 235 uses the quantized parameters $\bar{a}_i$, $\bar{b}_i$, and $\bar{t}_0$ to obtain an estimated phase spectrum, $\hat{\theta}_0(\omega)$, given by equation (22). A phase predictor 233 obtains an estimated phase spectrum, $\hat{\theta}_1(\omega)$, by prediction from the previous frame assuming the frequencies are linearly interpolated. A selector 237 selects the estimated phase spectrum, $\theta(\omega)$, that minimizes the weighted phase error, given by equation (23), where $A_k$ is the amplitude of each of the sinusoids, $\theta(\omega_k)$ is the true phase, and $\hat{\theta}(\omega_k)$ is the estimated phase. If the parametric method is selected, a parameter, phasemethod, is set to zero. If the prediction method is selected, the parameter, phasemethod, is set to one. An arrangement comprising summer 247, multiplier 245, and optimizer 240 is used to vector quantize the error remaining after the selected phase estimation method is used. Vector quantization consists of replacing the phase residual comprising the difference between $\theta(\omega_k)$ and $\hat{\theta}(\omega_k)$ with a random vector $\Psi_{c,k}$ selected from codebook 243 by an exhaustive search to determine the codeword that minimizes mean squared error given by equation (24). The index, I1, to the selected vector, and a scale factor $\gamma_c$ are thus determined. The resultant phase spectrum is generated by a summer 249. Delay unit 251 delays the resultant phase spectrum by one frame for use by phase predictor 251.

Figure 3:
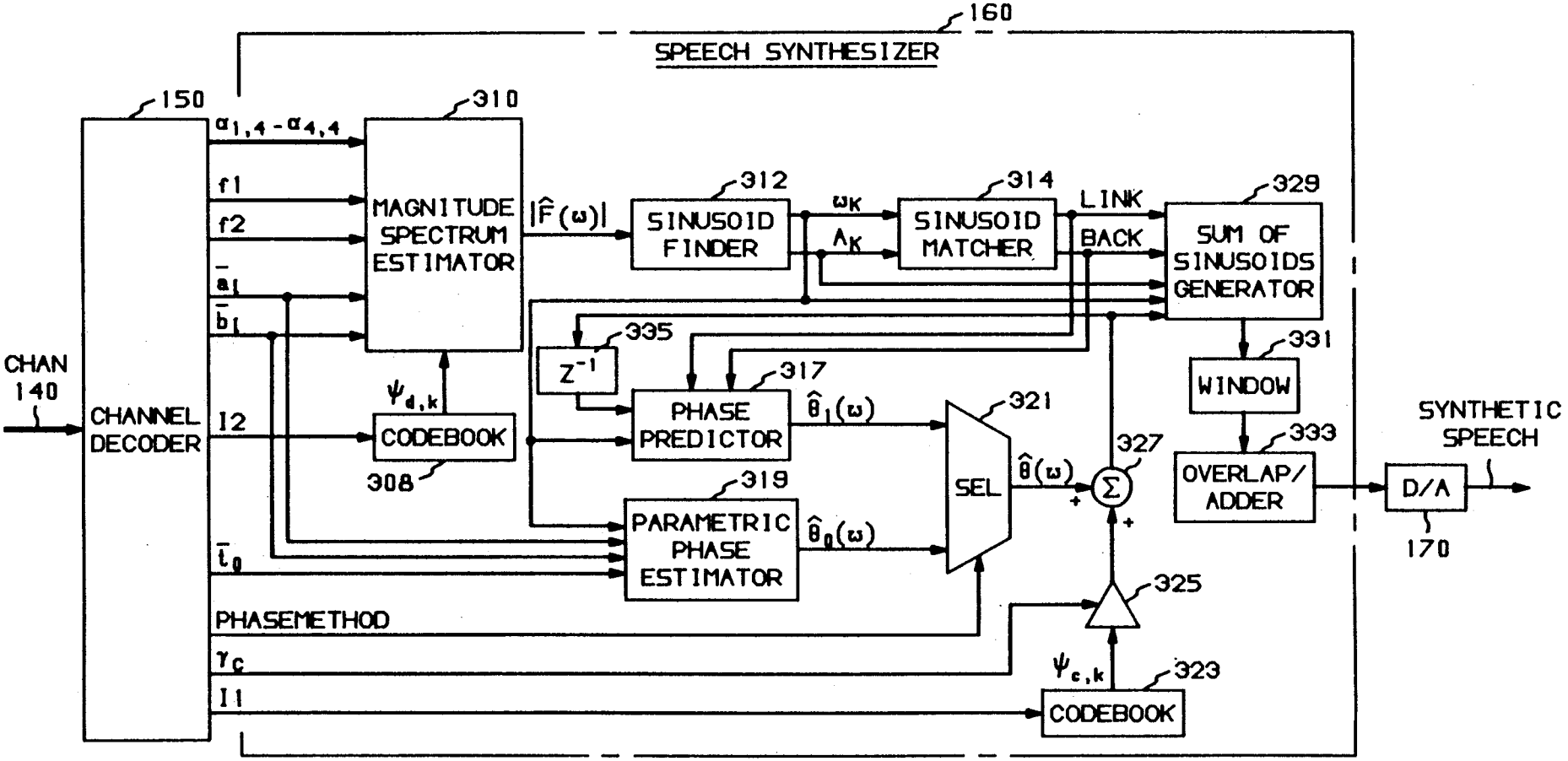
FIG. 3 is a block diagram of a speech synthesizer included in the arrangement of FIG. 1.
Figure 4:
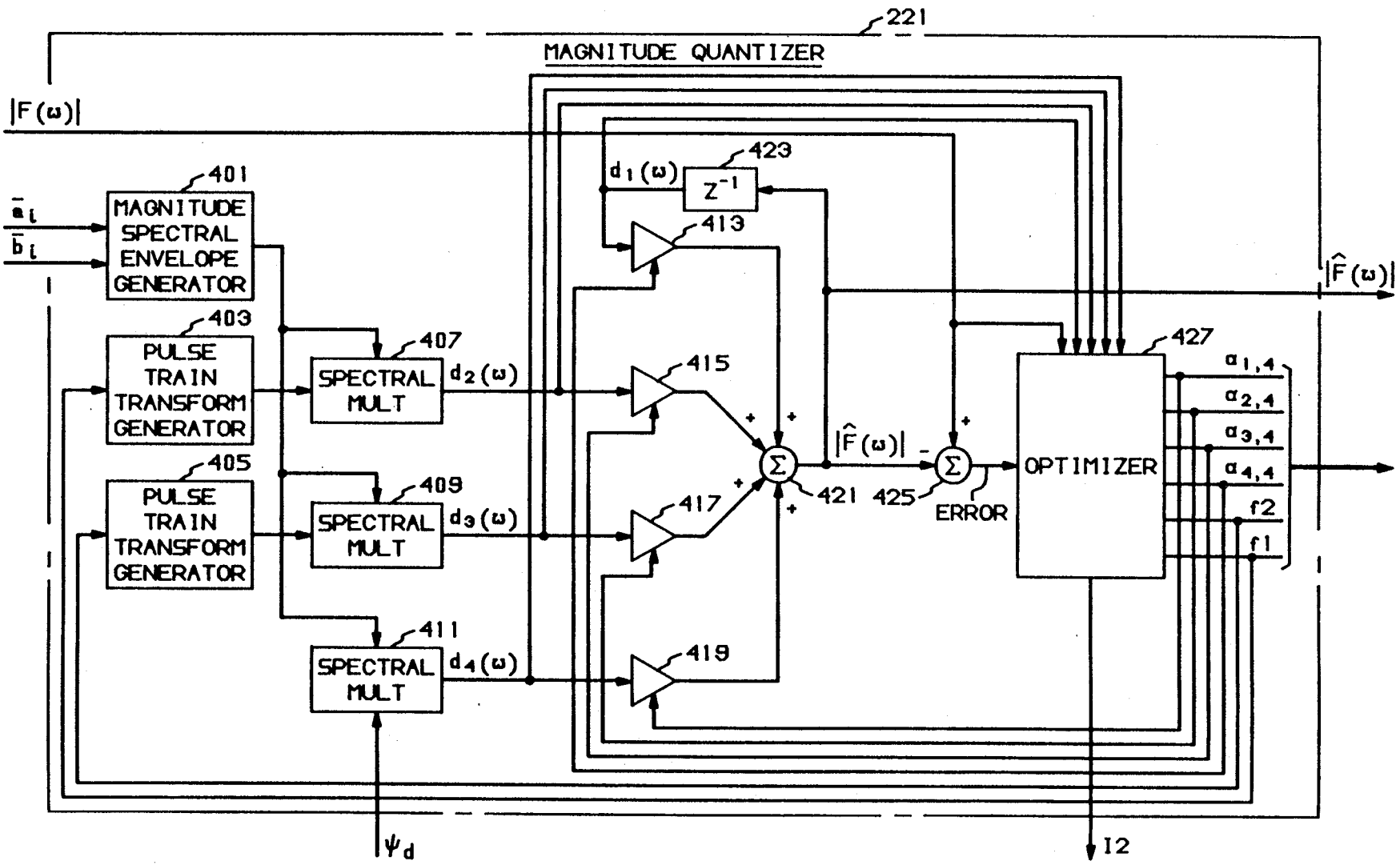
FIG. 4 is a block diagram of a magnitude quantizer included in the analyzer of FIG. 2.
Figure 5:
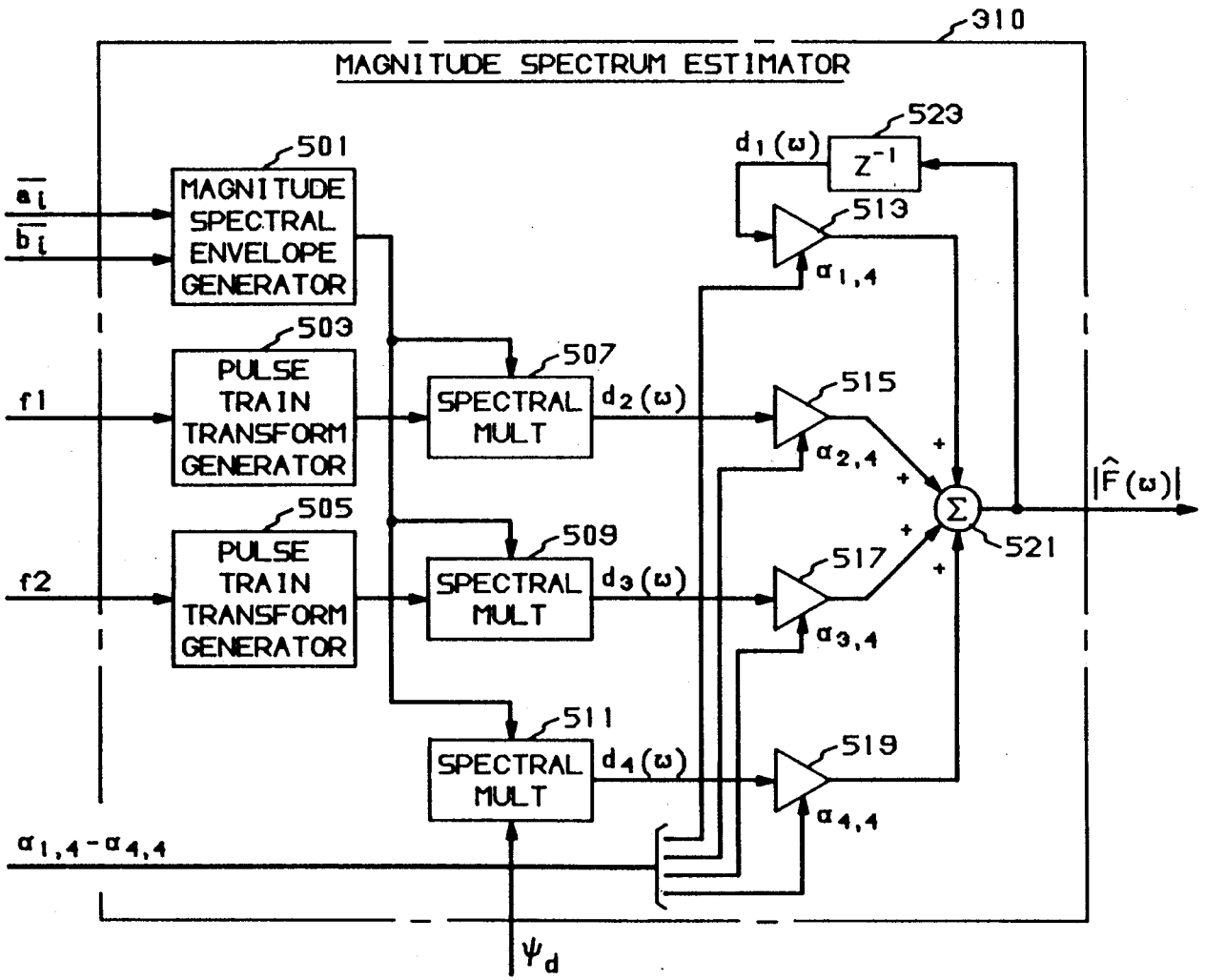
FIG. 5 is a block diagram of a magnitude spectrum estimator included in the synthesizer of FIG. 3.

Speech synthesizer 160 is shown in greater detail in FIG. 3. The received index, I2, is used to determine the vector, $\Psi_{d,k}$, from a codebook 308. The vector, $\Psi_{d,k}$, and the received parameters $\alpha_{1,4}$, $\alpha_{2,4}$, $\alpha_{3,4}$, $\alpha_{4,4}$, f1, f2, $\bar{a}_i$, $\bar{b}_i$ are used by a magnitude spectrum estimator 310 to determine the estimated magnitude spectrum $|\hat{F}(\omega)|$ in accordance with equation (1). The elements of estimator 310 (FIG. 5)—501, 503, 505, 507, 509, 511, 513, 515, 517, 519, 521, 523—perform the same function that corresponding elements—401, 403, 405, 407, 409, 411, 413, 415, 417, 419, 421, 423—perform in magnitude quantizer 221 (FIG. 4). A sinusoid finder 312 (FIG. 3) and sinusoid matcher 314 perform the same functions in synthesizer 160 as sinusoid finder 224 (FIG. 2) and sinusoid matcher 227 in analyzer 120 to determine the amplitude, $A_k$, and frequency, $\omega_k$, of a number of sinusoids, and the arrays BACK and LINK, defining the association of sinusoids of the present frame with sinusoids of the previous and subsequent frames respectively.

Note that the sinusoids determined in speech synthesizer 160 do not have predetermined frequencies. Rather the sinusoidal frequencies are dependent on the parameters received over channel 140 and are determined based on amplitude values of the estimated magnitude spectrum $|\hat{F}(\omega)|$. The sinusoidal frequencies are nonuniformly spaced.

A parametric phase estimator 319 uses the received parameters $\bar{a}_i$, $\bar{b}_i$, $\bar{t}_0$, together with the frequencies $\omega_k$ of the sinusoids determined by sinusoid finder 312 and either all-pole analysis or pole-zero analysis (performed in the same manner as described above with respect to analyzer 210 (FIG. 2) and analyzer 206) to determine an estimated phase spectrum, $\hat{\theta}_0(\omega)$. If the received parameters, $\bar{b}_i$, are all zero, all-pole analysis is performed. Otherwise, pole-zero analysis is performed. A phase predictor 317 (FIG. 3) obtains an estimated phase spectrum, $\hat{\theta}_1(\omega)$, from the arrays LINK and BACK in the same manner as phase predictor 233 (FIG. 2). The estimated phase spectrum is determined by estimator 319 or predictor 317 for a given frame dependent on the value of the received parameter, phasemethod. If phasemethod is zero, the estimated phase spectrum obtained by estimator 319 is transmitted via a selector 321 to a summer 327. If phasemethod is one, the estimated phase spectrum obtained by predictor 317 is transmitted to summer 327. The selected phase spectrum is combined with the product of the received parameter, $\gamma_c$, and the vector, $\Psi_{c,k}$, of codebook 323 defined by the received index I1, to obtain a resultant phase spectrum as given by either equation (25) or equation (26) depending on the value of phasemethod. The resultant phase spectrum is delayed one frame by a delay unit 335 for use by phase predictor 317. A sum of sinusoids generator 329 constructs K sinusoids of length W (the frame length), frequency $\omega_k$, $1 \leqq k \leqq K$, amplitude $A_k$, and phase $\theta_k$. Sinusoid pairs in adjacent frames that are matched to each other are linearly interpolated in frequency so that the sum of the pair is a continuous sinusoid. Unmatched sinusoids remain at constant frequency. Generator 329 adds the constructed sinusoids together, a window unit 331 windows the sum of sinusoids with a raised cosine window, and an overlap/adder 333 overlaps and adds with adjacent frames. The resulting digital samples are then converted by D/A converter 170 to obtain analog, synthetic speech.

Figure 6:
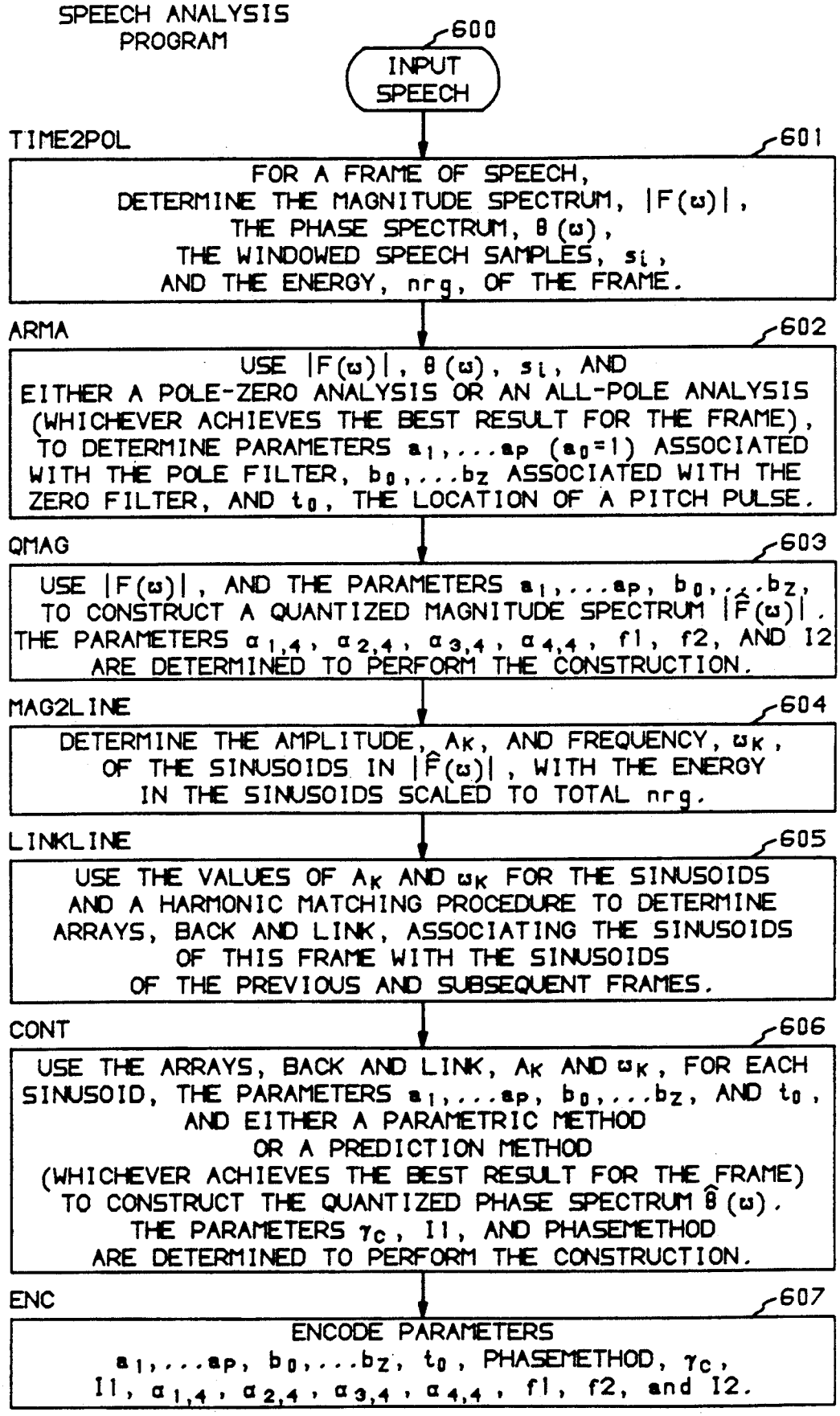
FIGS. 6 and 7 are flow charts of exemplary speech analysis and speech synthesis programs, respectively.
Figure 8:
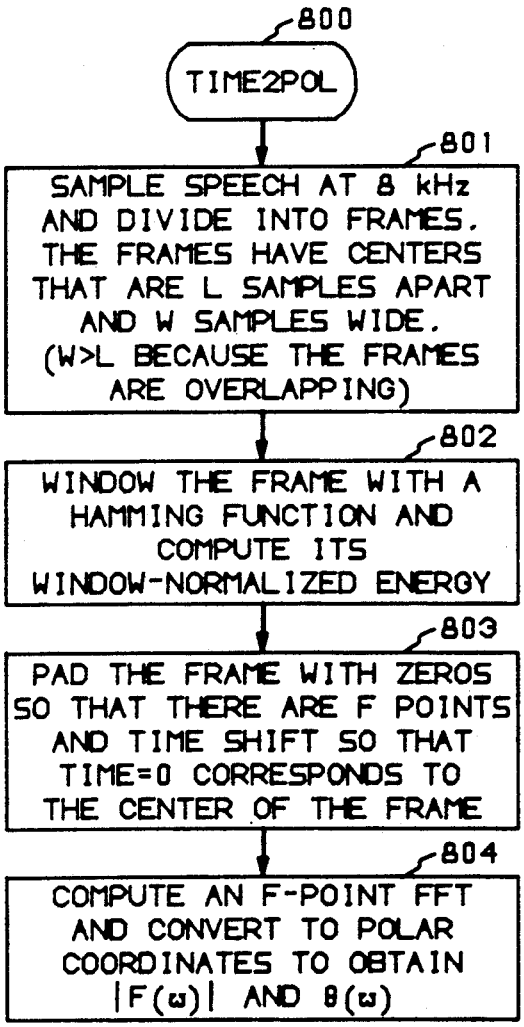
FIGS. 8 through 13 are more detailed flow charts of routines included in the speech analysis program of FIG. 6.
Figure 9:
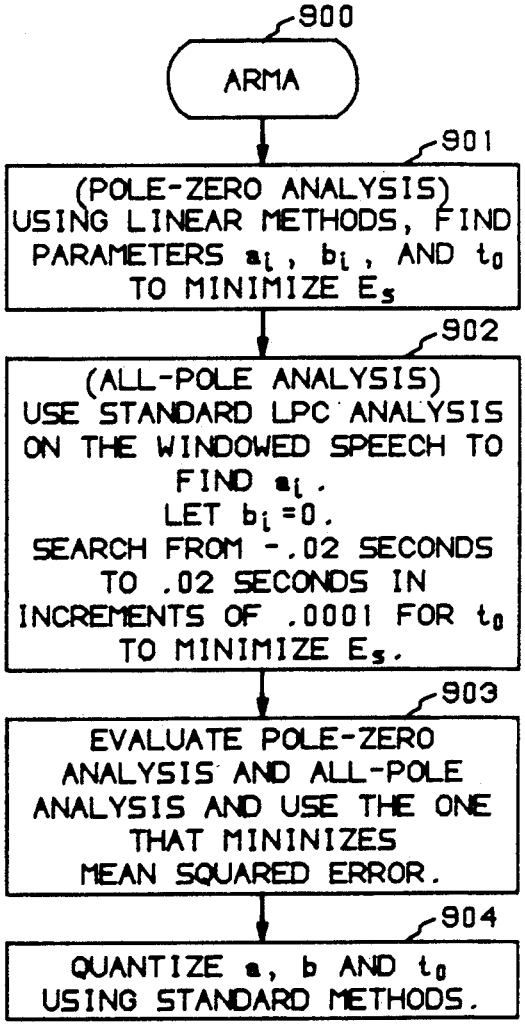
Figure 10:
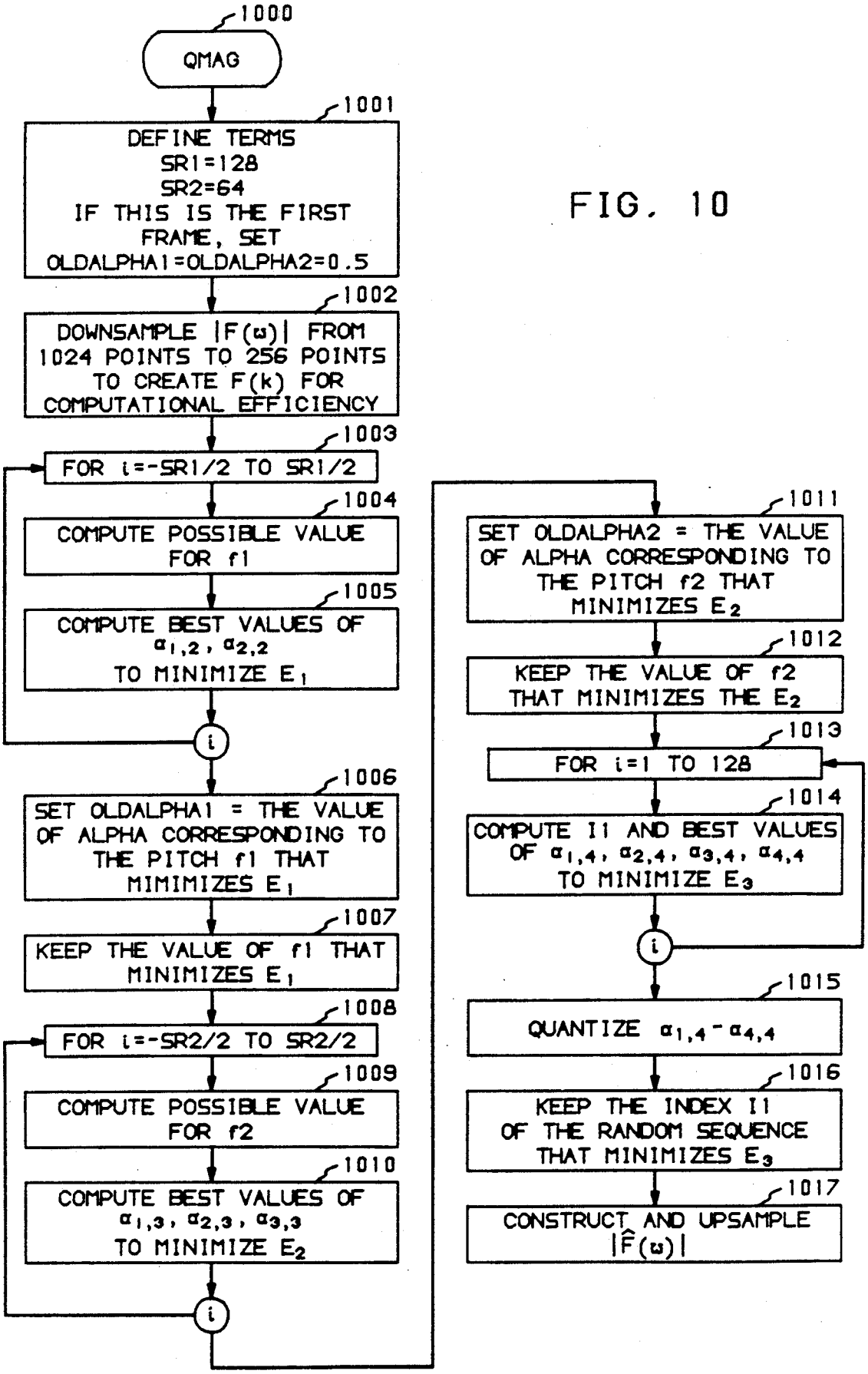
Figure 11:
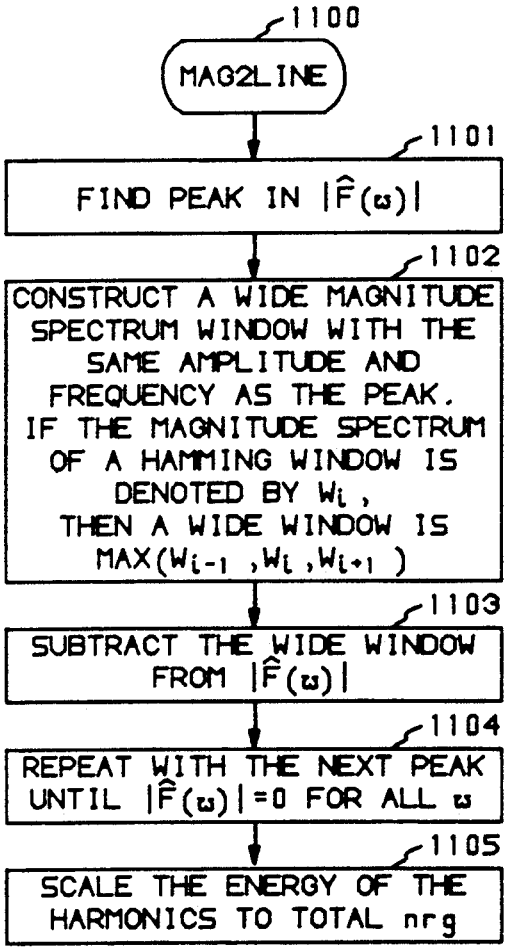
Figure 12:
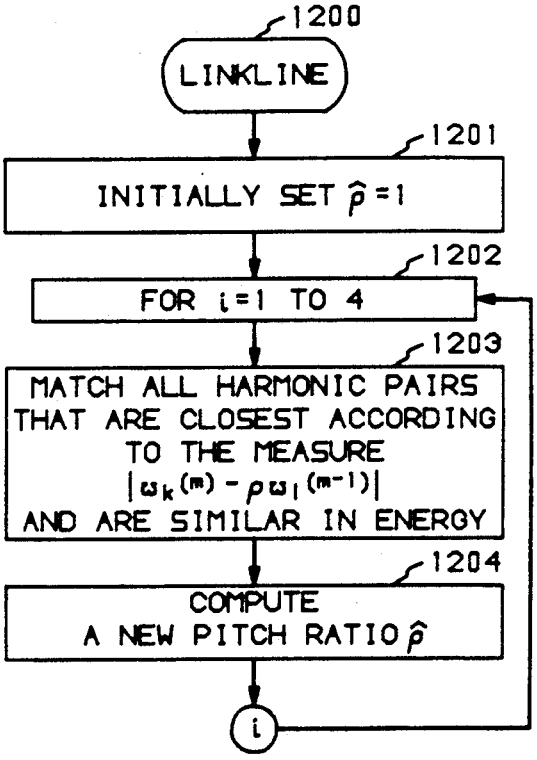
Figure 13:
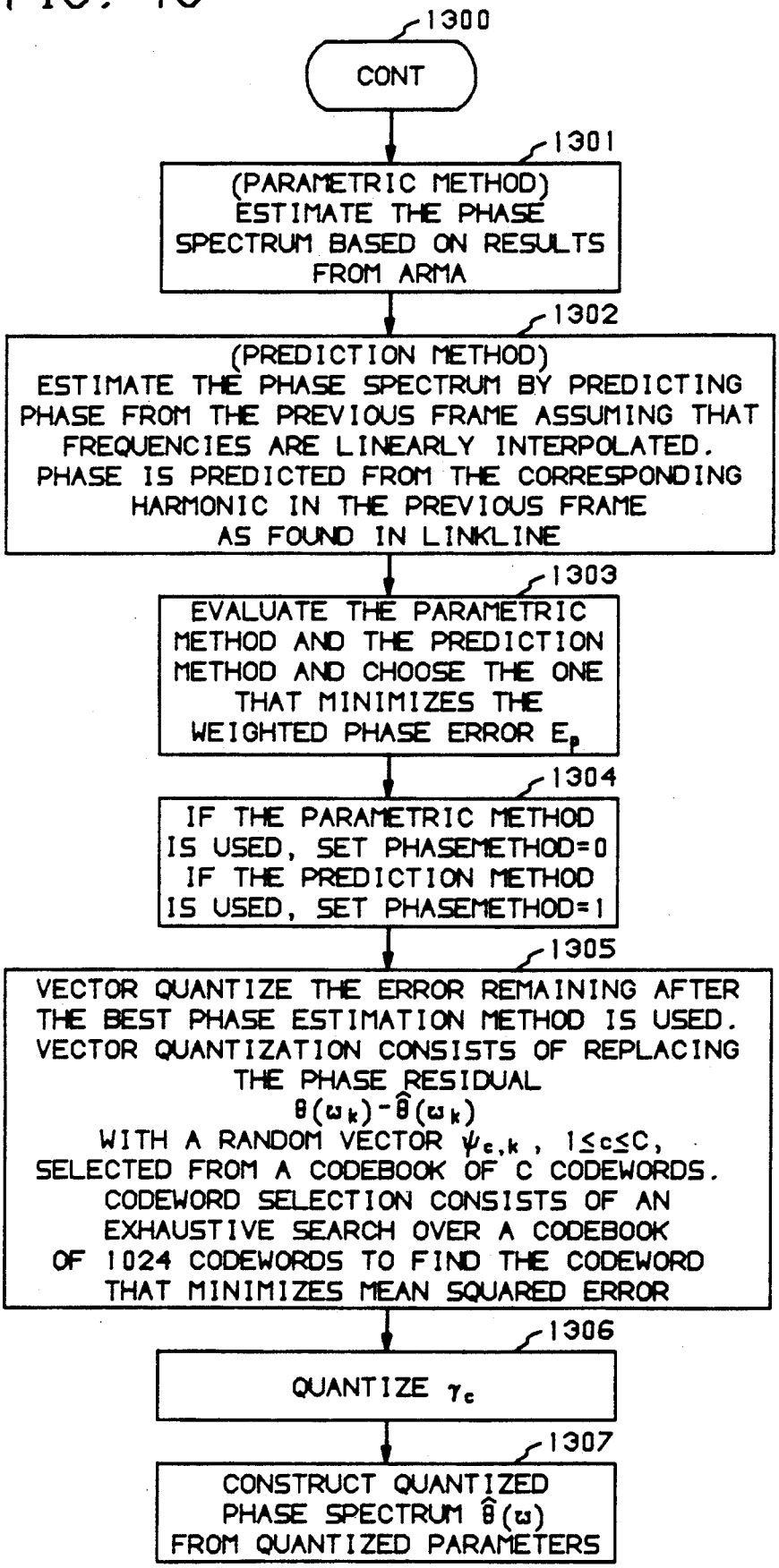

FIG. 6 is a flow chart of an illustrative speech analysis program that performs the functions of speech analyzer 120 (FIG. 1) and channel encoder 130. In accordance with the example, L, the spacing between frame centers is 160 samples. W, the frame length, is 320 samples. F, the number of samples of the FFT, is 1024 samples. The number of poles, P, and the number of zeros, Z, used in the analysis are eight and three, respectively. The analog speech is sampled at a rate of 8000 samples per second. The digital speech samples received at block 600 (FIG. 6) are processed by a TIME2POL routine 601 shown in detail in FIG. 8 as comprising blocks 800 through 804. The window-normalized energy is computed in block 802 using equation (10). Processing proceeds from routine 601 (FIG. 6) to an ARMA routine 602 shown in detail in FIG. 9 as comprising blocks 900 through 904. In block 902, $E_s$ is given by equation (5) where $H(\omega_k)$ is given by equation (4). Equation (11) is used for the all-pole analysis in block 903. Expression (12) is used for the mean squared error in block 904. Processing proceeds from routine 602 (FIG. 6) to a QMAG routine 603 shown in detail in FIG. 10 as comprising blocks 1000 through 1017. In block 1004, equations (13) and (14) are used to compute f1. In block 1005, $E_1$ is given by equation (15). In block 1009, equations (16) and (17) are used to compute f2. In block 1010, $E_2$ is given by equation (18). In block 1014, $E_3$ is given by equation (19). In block 1017, the estimated magnitude spectrum, $|\hat{F}(\omega)|$, is constructed using equation (20). Processing proceeds from routine 603 (FIG. 6) to a MAG2LINE routine 604 shown in detail in FIG. 11 as comprising blocks 1100 through 1105. Processing proceeds from routine 604 (FIG. 6) to a LINKLINE routine 605 shown in detail in FIG. 12 as comprising blocks 1200 through 1204. Sinusoid matching is performed between the previous and present frames and between the present and subsequent frames. The routine shown in FIG. 12 matches sinusoids between frames m and (m−1). In block 1203, pairs are not similar in energy if the ratio given by expression (7) is less that 0.25 or greater than 4.0. In block 1204, the pitch ratio, $\hat{\rho}$, is given by equation (21). Processing proceeds from routine 605 (FIG. 6) to a CONT routine 606 shown in detail in FIG. 13 as comprising blocks 1300 through 1307. In block 1301, the estimate is made by evaluating expression (22). In block 1303, the weighted phase error, is given by equation (23), where $A_k$ is the amplitude of each sinusoid, $\theta(\omega_k)$ is the true phase, and $\hat{\theta}(\omega_k)$ is the estimated phase. In block 1305, mean squared error is given by expression (24). In block 1307, the construction is based on equation (25) if the parameter, phasemethod, is zero, and is based on equation (26) if phasemethod is one. In equation (26), t, the time between frame centers, is given by L/8000. Processing proceeds from routine 606 (FIG. 6) to an ENC routine 607 where the parameters are encoded.

Figure 7:
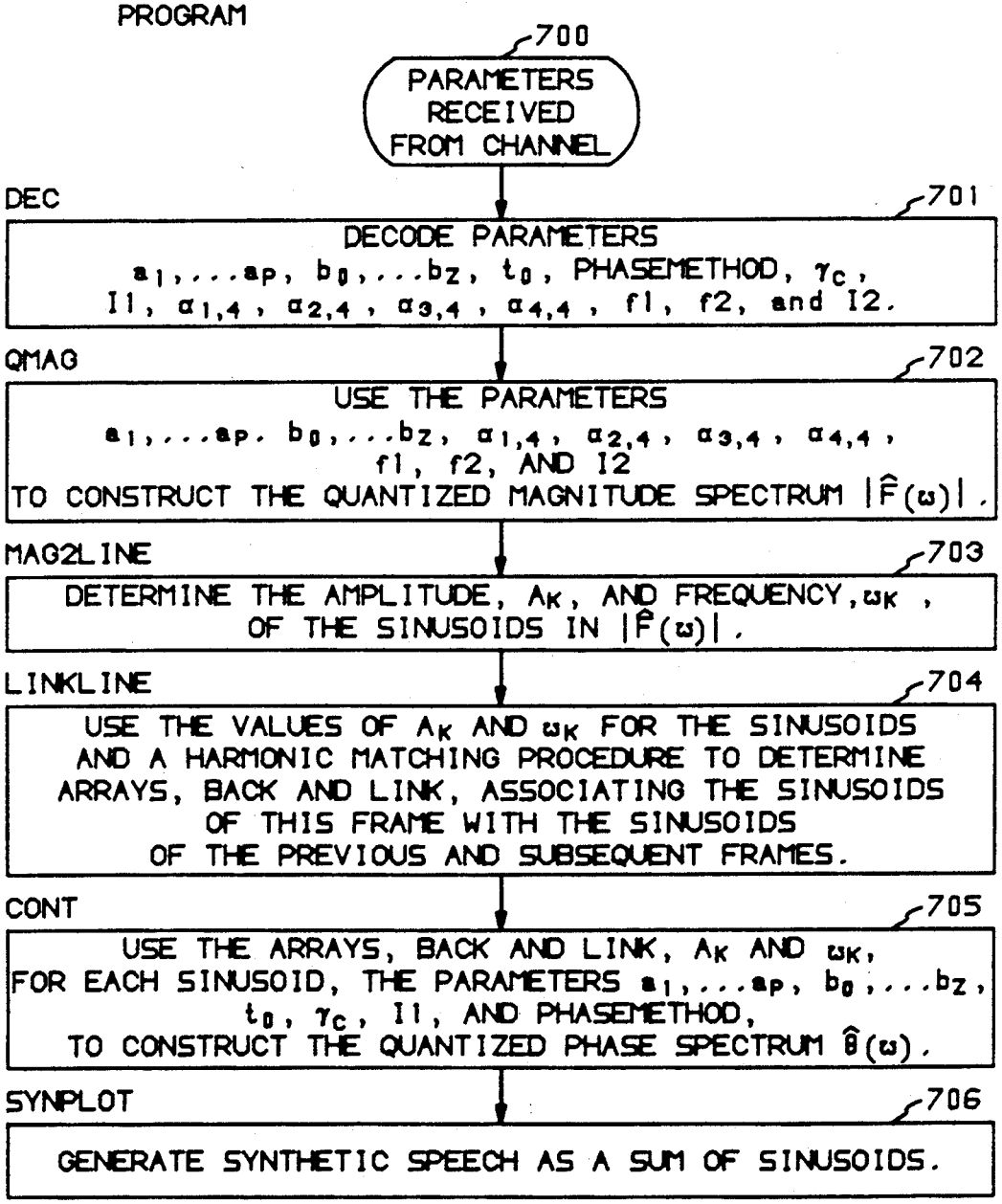
Figure 14:
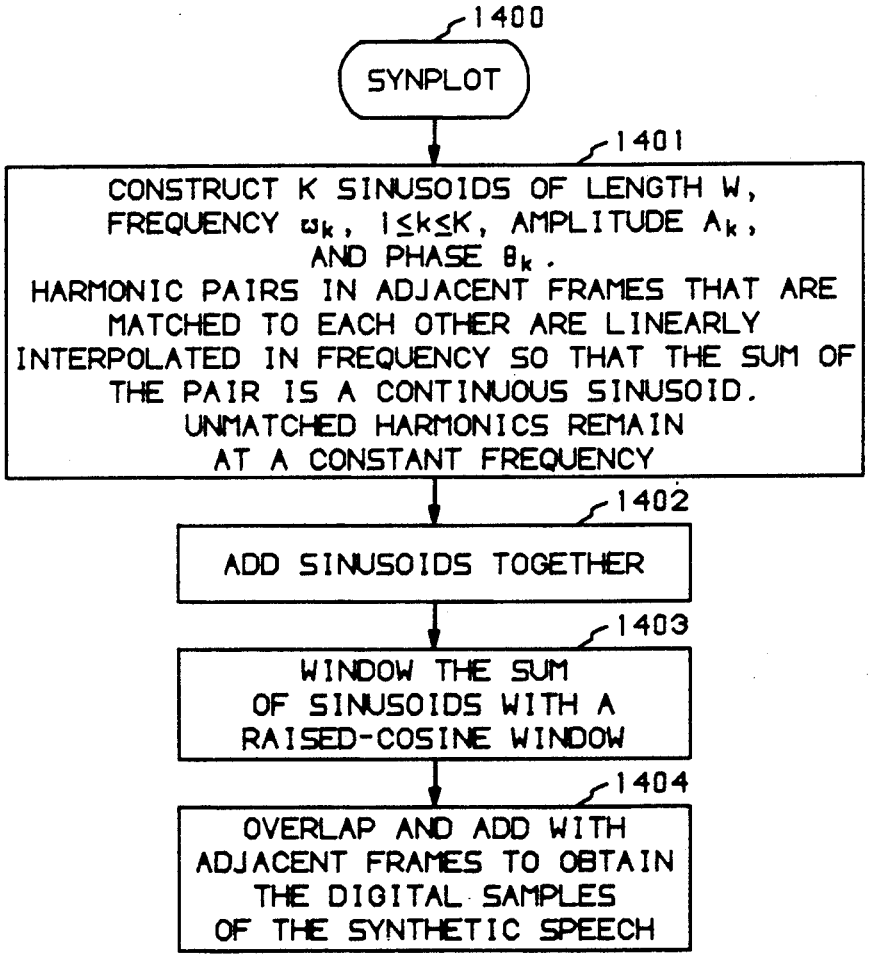
FIG. 14 is a more detailed flow chart of a routine included in the speech synthesis program of FIG. 7.

FIG. 7 is a flow chart of an illustrative speech synthesis program that performs the functions of channel decoder 150 (FIG. 1) and speech synthesizer 160. The parameters received in block 700 (FIG. 7) are decoded in a DEC routine 701. Processing proceeds from routine 701 to a QMAG routine 702 which constructs the quantized magnitude spectrum $|\hat{F}(\omega)|$ based on equation (1). Processing proceeds from routine 702 to a MAG2LINE routine 703 which is similar to MAG2LINE routine 604 (FIG. 6) except that energy is not rescaled. Processing proceeds from routine 703 (FIG. 7) to a LINKLINE routine 704 which is similar to LINKLINE routine 605 (FIG. 6). Processing proceeds from routine 704 (FIG. 7) to a CONT routine 705 which is similar to CONT routine 606 (FIG. 6), however only one of the phase estimation methods is performed (based on the value of phasemethod) and, for the parametric estimation, only all-pole analysis or pole-zero analysis is performed (based on the values of the received parameters $b_i$). Processing proceeds from routine 705 (FIG. 7) to a SYNPLOT routine 706 shown in detail in FIG. 14 as comprising blocks 1400 through 1404.

The routines shown in FIGS. 8 through 14 are found in the C language source program of the Microfiche Appendix. The C language source program is intended for execution on a Sun Microsystems Sun 3/110 computer system with appropriate peripheral equipment or a similar system.

Figure 15:
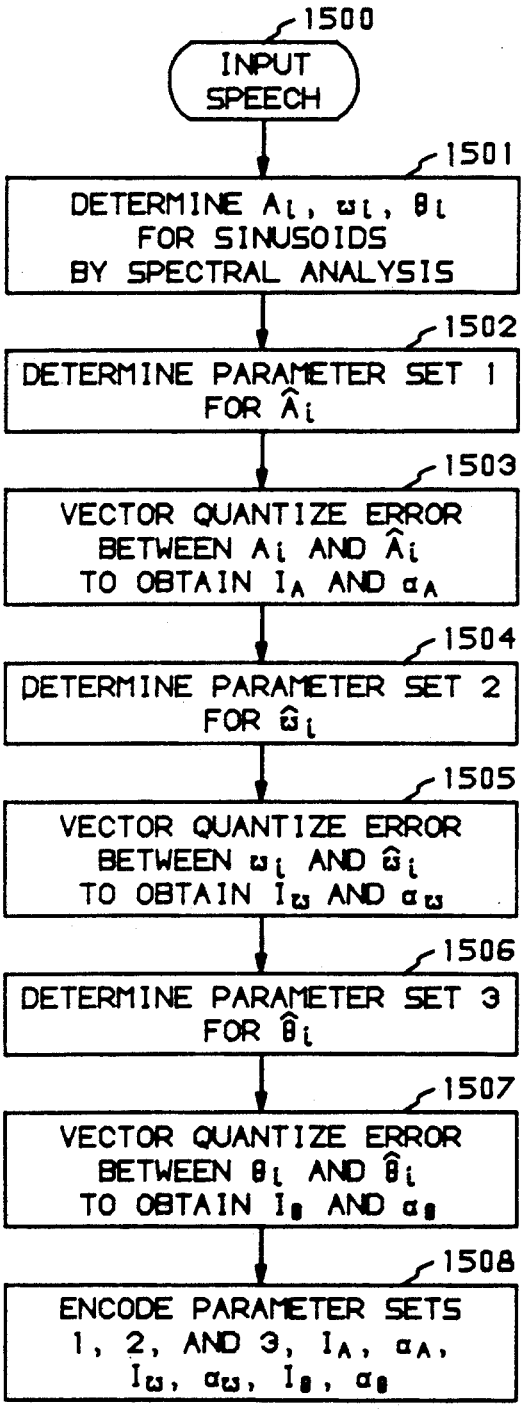
FIGS. 15 and 16 are flow charts of alternative speech analysis and speech synthesis programs, respectively.
Figure 16:
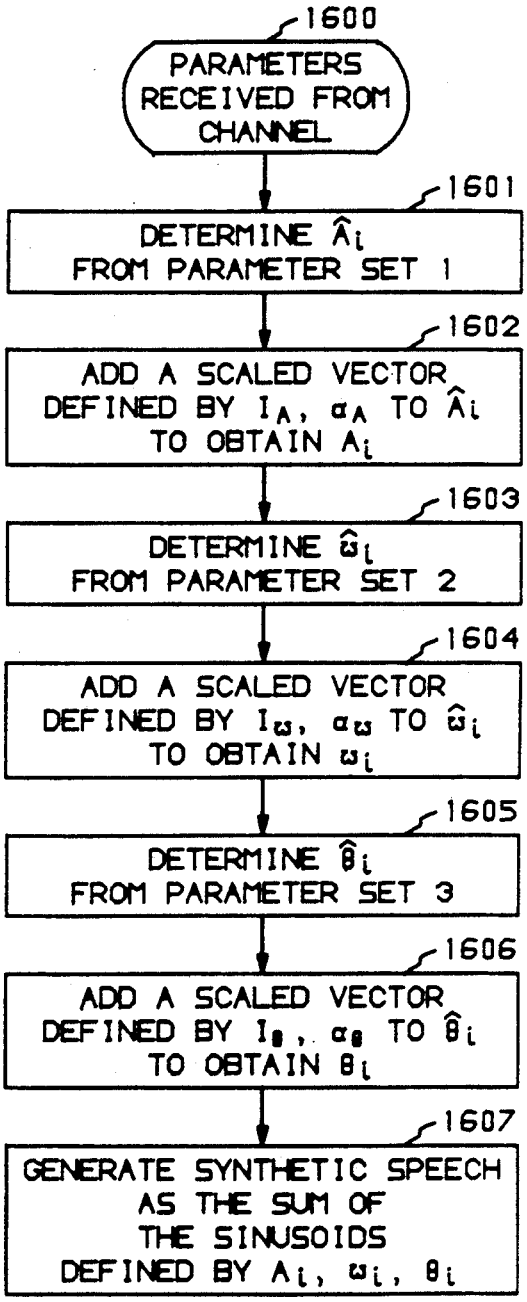

FIGS. 15 and 16 are flow charts of alternative speech analysis and speech synthesis programs, respectively, for harmonic speech coding. In FIG. 15, processing of the input speech begins in block 1501 where a spectral analysis, for example finding peaks in a magnitude spectrum obtained by performing an FFT, is used to determine $A_i$, $\omega_i$, $\theta_i$ for a plurality of sinusoids. In block 1502, a parameter set 1 is determined in obtaining estimates, $\hat{A}_i$, using, for example, a linear predictive coding (LPC) analysis of the input speech. In block 1503, the error between $A_i$ and $\hat{A}_i$ is vector quantized in accordance with an error criterion to obtain an index, $I_A$, defining a vector in a codebook, and a scale factor, $\alpha_A$. In block 1504, a parameter set 2 is determined in obtaining estimates, $\hat{\omega}_i$, using, for example, a fundamental frequency, obtained by pitch detection of the input speech, and multiples of the fundamental frequency. In block 1505, the error between $\omega_i$ and $\hat{\omega}_i$ is vector quantized in accordance with an error criterion to obtain an index, $I_\omega$, defining a vector in a codebook, and a scale factor $\alpha_\omega$. In block 1506, a parameter set 3 is determined in obtaining estimates, $\hat{\theta}_i$, from the input speech using, for example either parametric analysis or phase prediction as described previously herein. In block 1507, the error between $\theta_i$ and $\hat{\theta}_i$ is vector quantized in accordance with an error criterion to obtain an index, $I_\theta$, defining a vector in a codebook, and a scale factor, $\alpha_\theta$. The various parameter sets, indices, and scale factors are encoded in block 1508. (Note that parameter sets 1, 2, and 3 are typically not disjoint sets.)

FIG. 16 is a flow chart of the alternative speech synthesis program. Processing of the received parameters begins in block 1601 where parameter set 1 is used to obtain the estimates, $\hat{A}_i$. In block 1602, a vector from a codebook is determined from the index, $I_A$, scaled by the scale factor, $\alpha_A$, and added to $\hat{A}_i$ to obtain $A_i$. In block 1603, parameter set 2 is used to obtain the estimates, $\hat{\omega}_i$. In block 1604, a vector from a codebook is determined from the index, $I_\omega$, scaled by the scale factor, $\alpha_\omega$, and added to $\hat{\omega}_i$ to obtain $\omega_i$. In block 1605, a parameter set 3 is used to obtain the estimates, $\hat{\theta}_i$. In block 1606, a vector from a codebook is determined from the index, $I_\theta$, and added to $\hat{\theta}_i$ to obtain $\theta_i$. In block 1607, synthetic speech is generated as the sum of the sinusoids defined by $A_i$, $\omega_i$, $\theta_i$.

It is to be understood that the above-described harmonic speech coding arrangements are merely illustrative of the principles of the present invention and that many variations may be devised by those skilled in the art without departing from the spirit and scope of the invention. For example, in the illustrative harmonic speech coding arrangements described herein, parameters are communicated over a channel for synthesis at the other end. The arrangements could also be used for efficient speech storage where the parameters are communicated for storage in memory, and are used to generate synthetic speech at a later time. It is therefore intended that such variations be included within the scope of the claims.

I claim:

1. In a harmonic speech coding arrangement, a method of processing speech comprising determining a spectrum comprising a Fourier transform of said speech, calculating, based on said determined spectrum, a set of parameters modeling said speech, at least one parameter of said parameter set comprising an index to a codebook of vectors, communicating said calculated parameter set including said index, receiving said communicated parameter set including said index, processing said received parameter set including said index to determine a plurality of sinusoids corresponding to harmonics of said speech, and synthesizing speech as a sum of said sinusoids.

2. A method in accordance with claim 1 wherein said determined spectrum comprises a magnitude spectrum.

3. A method in accordance with claim 2 wherein said codebook of vectors comprises vectors constructed from a transform of a plurality of sinusoids with random frequencies and amplitudes.

4. A method in accordance with claim 2 wherein said calculating comprises finding peaks in said magnitude spectrum, and determining a plurality of sinusoids corresponding to said peaks.

5. A method in accordance with claim 2 wherein said processing comprises determining a magnitude spectrum from said received parameter set including said index, and determining a sinusoidal amplitude and a sinusoidal frequency for each of said sinusoids from said magnitude spectrum determined from said received parameter set.

6. A method in accordance with claim 5 wherein said determining a sinusoidal amplitude and a sinusoidal frequency comprises finding peaks in said magnitude spectrum determined from said received parameter set, and determining said sinusoidal amplitude and said sinusoidal frequency for each of said sinusoids from said peaks in said magnitude spectrum.

7. A method in accordance with claim 1 wherein said determined spectrum comprises a phase spectrum.

8. A method in accordance with claim 7 wherein said codebook of vectors comprises vectors constructed from white Gaussian noise sequences.

9. A method in accordance with claim 7 wherein said processing comprises determining a phase spectrum from said received parameter set including said index, and determining a sinusoidal phase for each of said sinusoids from said phase spectrum determined from said received parameter set.

10. A method in accordance with claim 1 wherein said determined spectrum comprises a Fast Fourier Transform of said speech.

11. A method in accordance with claim 1 wherein said determined spectrum comprises an interpolated spectrum.

12. A method in accordance with claim 1 wherein said calculating comprises determining a plurality of sinusoids from said determined spectrum, and selecting said index to minimize error in accordance with an error criterion at the frequencies of said sinusoids.

13. A method in accordance with claim 1 wherein said processing comprises determining a sinusoidal amplitude for each of said sinusoids based in part on a vector defined by said received index.

14. A method in accordance with claim 1 wherein said processing comprises determining a sinusoidal frequency for each of said sinusoids based in part on a vector defined by said received index.

15. A method in accordance with claim 1 wherein said processing comprises determining a sinusoidal phase for each of said sinusoids based in part on a vector defined by said received index.

16. In a harmonic speech coding arrangement, a method of processing speech comprising determining a spectrum from said speech, calculating, based on said determined spectrum, a set of parameters modeling said speech and communicating said parameter set, wherein at least one parameter of said parameter set comprises an index to a codebook of vectors, and wherein said determining comprises determining a magnitude spectrum and a phase spectrum, and wherein said calculating comprises calculating said parameter set comprising first parameters modeling said determined magnitude spectrum and second parameters modeling said determined phase spectrum, at least one of said first parameters comprising an index to a first codebook of vectors, and at least one of said second parameters comprising an index to a second codebook of vectors.

17. In a harmonic speech coding arrangement, a method of processing speech comprising determining a spectrum from said speech, calculating, based on said determined spectrum, a set of parameters modeling said speech and communicating said parameter set, wherein at least one parameter of said parameter set comprises an index to a codebook of vectors, and wherein said calculating comprises determining a plurality of sinusoids from said determined spectrum, including determining sinusoidal amplitude of each of said plurality of sinusoids, estimating, based on said speech, sinusoidal amplitude of each of said plurality of sinusoids, determining errors between said determined sinusoidal amplitudes and said estimated sinusoidal amplitudes, and vector quantizing said determined errors to determine said index.

18. In a harmonic speech coding arrangement, a method of processing speech comprising determining a spectrum from said speech, calculating, based on said determined spectrum, a set of parameters modeling said speech and communicating said parameter set, wherein at least one parameter of said parameter set comprises an index to a codebook of vectors, and wherein said calculating comprises determining a plurality of sinusoids from said determined spectrum, including determining sinusoidal frequency of each of said plurality of sinusoids, estimating, based on said speech, sinusoidal frequency of each of said plurality of sinusoids, determining errors between said determined sinusoidal frequencies and said estimated sinusoidal frequencies, and vector quantizing said determined errors to determine said index.

19. In a harmonic speech coding arrangement, a method of processing speech comprising determining a spectrum from said speech, calculating, based on said determined spectrum, a set of parameters modeling said speech and communicating said parameter set, wherein at least one parameter of said parameter set comprises an index to a codebook of vectors, and wherein said calculating comprises determining a plurality of sinusoids from said determined spectrum, including determining sinusoidal phase of each of said plurality of sinusoids, estimating, based on said speech, sinusoidal phase of each of said sinusoids, determining errors between said determined sinusoidal phases and said estimated sinusoidal phases, and vector quantizing said determined errors to determine said index.

20. A harmonic coding arrangement for processing speech comprising means responsive to said speech for determining a spectrum comprising a Fourier transform of said speech, means responsive to said determining means for calculating, based on said determined spectrum, a set of parameters modeling said speech, at least one parameter of said parameter set comprising an index to a codebook of vectors, means for communicating said calculated parameter set including said index, means for receiving said communicated parameter set including said index, means for processing said received parameter set including said index to determine a plurality of sinusoids corresponding to harmonics of said speech, and means for synthesizing speech as a sum of said sinusoids.

* * * * *

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-identified patent and that said Letters Patent is hereby corrected as shown below:

ON THE COVER PAGE:

"[22] Filed: Apr. 8, 1989" should be "[22] Filed: Apr. 8, 1988".

Signed and Sealed this

Twenty-second Day of June, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-indentified patent and that said Letters Patent is hereby corrected as shown below:

Column 4, line 53, equation 1 should be $$" \quad |\hat{F}(\omega)| = \sum_{i=1}^{m} \alpha_{i,m} d_i(\omega) \, . \qquad (1) \quad "$$

Column 4, line 61, equation 2 should be $$" \quad \int_0^{\omega_s/2} \left[ |F(\omega)| - \sum_{i=1}^{m} \alpha_{i,m} d_i(\omega) \right]^2 d\omega \, , \qquad (2) \quad "$$

Column 5, line 49, equation 4 should be $$" \quad H(\omega_k) = \frac{\sum_{i=0}^{q} b_i e^{-j\omega_k i}}{\sum_{i=0}^{p} a_i e^{-j\omega_k i}} \, . \qquad (4) \quad "$$

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-indentified patent and that said Letters Patent is hereby corrected as shown below:

Column 5, line 57, equation 5 should be $$" \quad E_s = \sum_{k=1}^{K} |e^{-j\omega_k t_0} H(\omega_k) - F(\omega_k)|^2. \qquad (5) \quad "$$

Column 6, line 22, the equation should read $$" \quad A_k^2[1 - \cos(\nu_k)]. \quad "$$

Column 6, line 25, equation 6 should read $$" \quad \sum_{k=1}^{K} A_k^2[1 - \cos(\varepsilon_k - \psi_{c,k})] \qquad (6) \quad "$$

Column 7, line 4, equation 9 should read $$" \quad \hat{\gamma} = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}} . \qquad (9) \quad "$$

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-indentified patent and that said Letters Patent is hereby corrected as shown below:

Column 8, line 14, equation 11 should read $$" \quad H(\omega_k) = \frac{1}{\sum_{i=0}^{p} a_i e^{-j\omega_k i}} \qquad (11) \quad "$$

Column 8, line 41, equation 20 should read $$" \quad |\hat{F}(\omega)| = \sum_{i=1}^{4} \alpha_{i,4} d_i(\omega) \qquad (20) \quad "$$

Column 8, line 45, equation 21 should read $$" \quad \hat{\rho} = \sum_{k=1}^{K} \frac{[A_k^{(m)}]^2}{\sum_{i=1}^{K} [A_i^{(m)}]^2} \cdot \frac{\omega_k^{(m)}}{\omega_k^{(m-1)}} \qquad (21) \quad "$$

Column 8, line 48, equation 22 should read $$" \quad \hat{\theta}(\omega_k) = \arg\left[e^{-j\omega_k t_0} H(\omega_k)\right] \qquad (22) \quad "$$

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-indentified patent and that said Letters Patent is hereby corrected as shown below:

Column 8, line 50, equation 23 should read $$" \quad E_p = \sum_{k=1}^{K} A_k^2[1 - \cos(\theta(\omega_k) - \hat{\theta}(\omega_k))] \qquad (23) \quad "$$

Column 8, line 55, equation 24 should read $$" \quad \sum_{k=1}^{K} A_k^2[1 - \cos(\theta(\omega_k) - \hat{\theta}(\omega_k) - \gamma_c \psi_{c,k})] \qquad (24) \quad "$$

Column 8, line 57, equation 25 should read $$" \quad \hat{\theta}(\omega_k) = \arg[e^{-j\omega_k t_0} H(\omega_k)] + \gamma_c \psi_{c,k} \qquad (25) \quad "$$

UNITED STATES PATENT AND TRADEMARK OFFICE

CERTIFICATE OF CORRECTION

PATENT NO. : 5,023,910

DATED : June 11, 1991

INVENTOR(S) : David L. Thomson

It is certified that error appears in the above-indentified patent and that said Letters Patent is hereby corrected as shown below:

Column 8, line 60, equation 26 should read $$" \quad \hat{\theta}_m(\omega_k) = \frac{\omega_k^{(m)} + \omega_l^{(m-1)}}{2} t + \gamma_c \, \psi_{c,k} \qquad (26) \quad "$$

Signed and Sealed this

Twenty-fourth Day of May, 1994

Bruce Lehman

*Attest:*

BRUCE LEHMAN

*Attesting Officer*

*Commissioner of Patents and Trademarks*